United States Patent [19]

Schmitz, Jr.

[11] 4,335,909

[45] Jun. 22, 1982

[54] MULTIPLE LOCK FOR AN ENGINE COMPARTMENT COVER SYSTEM

[75] Inventor: Floyd A. Schmitz, Jr., Burlington, Iowa

[73] Assignee: J. I. Case Company, Racine, Wis.

[21] Appl. No.: 121,434

[22] Filed: Feb. 14, 1980

[51] Int. Cl.[3] ..... E05C 5/00

[52] U.S. Cl. ..... 292/5; 70/159; 70/240; 70/264; 292/35; 292/DIG. 3; 292/DIG. 14; 292/DIG. 18; 312/220

[58] Field of Search ..... 292/5–7, 292/35, 36, 177, DIG. 3, DIG. 12, DIG. 14, DIG. 18; 70/158–164, 238, 240, 264, 114, 116; 312/220

[56] References Cited

U.S. PATENT DOCUMENTS

| | | | |
|---|---|---|---|
| 1,247,052 | 11/1917 | Wilson | 292/5 |
| 1,592,703 | 7/1926 | Petersson | 292/5 |
| 1,711,535 | 5/1929 | Leet | 70/240 X |
| 1,818,366 | 8/1931 | Vargo | 292/177 |
| 1,966,976 | 7/1934 | Coyle et al. | 292/36 |
| 2,114,208 | 4/1938 | Bogard | 292/177 X |
| 3,557,897 | 1/1971 | Conner et al. | 180/90 |
| 4,237,709 | 12/1980 | Krugener et al. | 292/5 X |

FOREIGN PATENT DOCUMENTS

| | | | |
|---|---|---|---|
| 523095 | 10/1953 | Belgium | 70/159 |
| 363424 | 5/1906 | France | 292/36 |

*Primary Examiner*—William E. Lyddane

*Attorney, Agent, or Firm*—Dressler, Goldsmith, Shore, Sutker & Milnamow, Ltd.

[57] ABSTRACT

An articulated linkage locks the various access panels, covers, and plates opening into an engine and its accessories. A spring loaded shaft is used to drive a bell crank and a set of catch bolts. Each catch bolt is matched with a catch plate joined to one of the panels, covers and plates granting access to the engine and its components. A pair of doors covering the instrument panel is used to reposition the spring loaded shaft and bell crank. Locking the doors together therefore locks the catch bolt and catch plates together in one stroke and with one lock.

12 Claims, 3 Drawing Figures

MULTIPLE LOCK FOR AN ENGINE COMPARTMENT COVER SYSTEM

DESCRIPTION

1. Technical Field

Apparatus for locking the covers and openings providing access to the engine compartment of mobile equipment used in the construction trades. In particular, a linkage for locking in place the various covers and panels providing unrestricted access to the engine, engine components and accessories of an off-road machine.

2. Background of the Invention

It is common knowledge that stealing automobiles is one of the major criminal activities in the United States. However, it is not too widely known that the mobile equipment and off-road machines used in civil engineering projects and construction activities, such as backhoes, uni-loaders and bulldozers, are equally lucrative targets for thieves. Because these machines are very expensive and are often left unattended in remote locations they tend to attract vandals. They are also a natural attraction for children. For the most part, they provide a harmless play toy for children. On the other hand, there are children who view these unattended vehicles as being an open target for mischief.

While little can be done to protect these machines against professional preditors, much can be done to protect these machines from amateur thieves and petty vandalism. For example, one particular target of vandalism has been the instrument panel and gauges used to operate the engine and its associated components. Ordinary glass and plastic is not effective in protecting these devices from vandals. It has been found necessary to cover these gauges with a strong metal plate and to hold that plate in place with a strong padlock.

There are several obvious expedients to protect these machines from damage. The first is to remove all keys when the machine is left unattended. These keys often provide access to storage and access compartments and start the engine. Another obvious expedient is the installation of a burglar alarm. However, since these machines are frequently left unattended in remote areas, the sound of a burglar alarm is not likely to deter the vandal or thief. Frequently, these vehicles are vandalized by pouring sugar in the fuel tank and sand into the radiator. Again, the obvious expedient is to install a series of locking caps and panels.

If one considers the number of access ports, panels, and covers that have to be provided with locks and hasps, it becomes readily apparent that a complete set of keys and padlocks are required to provide even a minimal amount of protection. Because of the relatively hostile environment in which these machines are used, the locks and hardware must be made of rust-proof materials such as stainless steel and brass. This often means that an individual lock can cost as much as $25.00 (United States) each. Since a lock is no better than its door or cover to which it is attached, the corresponding access panel or cover must often be reinforced to a strength comparable to that of the padlock. If the doors and padlocks are not reinforced, they often can be broken into by simply using the relatively stronger padlock as a lever to snap the hasp. Again, this is expensive.

It is also a matter of common experience that keys can be easily lost. Without the key even authorized access to the machine is denied. So-called "matched" or "series locks and keys" are more expensive to purchase and install. In addition, these special keys cannot be readily duplicated. Often the keys can be duplicated only at the factory of the lock manufacturer. Thus, while this non-duplication feature limits access by unauthorized individuals, it sometimes unnecessarily restricts authorized access by machine operators and maintenance personnel. Combination locks, while eliminating the problem of key duplication and key loss, are even more expensive than ordinary padlocks and are frequently damaged beyond repair by untrained personnel in an effort to change the combination.

Typically, the present state of the art requires one lock to protect the engine radiator cap, one lock to protect the fuel cap, two locks to protect the engine side panels (one on each side of the engine) and one lock to protect the instrument panel cover.

It has been the inventor's experience that the installation of multiple anti-vandalism covers, key locks and padlocks is not an effective solution to the problem. Machinery operators are especially unlikely to accept a security system based on multiple keys and locks. These personnel are concerned with other things and cannot be expected to be security experts or locksmiths. What is desirable is to provide a means for effectively denying access to the critical components of the engine while, at the same time, not deterring or unnecessarily hampering authorized personnel.

A simple, but effective, device combining the advantages of a removable padlock or a combination lock along with the ease and simplicity of one step operation would provide an optimal solution to the protection of the engine and its accessories. In particular, it is desirable to use a locking system that in one step effectively opens and closes or locks and unlocks all the various covers and panels providing access to the engine and its critical components.

SUMMARY OF THE INVENTION

In accordance with the present invention, a single spring loaded linkage is provided within the engine compartment of an off-road machine to lock the various covers, panels and caps associated with the engine and its major accessories. In particular, a spring loaded rod is located within the engine compartment. One end of the spring-loaded rod protrudes into the instrument panel. Closing the instrument panel cover plate effectively repositions the spring-loaded rod.

Joined to the rod are a series of catch bolts which cooperate with a corresponding set of catch plates. These catch plates are attached to covers hingedly joined to the vehicle body in the immediate vicinity of the spring-loaded rod. Covers farther from this rod and to either side of the engine compartment are locked in place by a bell crank positioned by the spring-loaded rod. The bell crank is joined to a set of catch bolts which match a series of catch plates attached to the various covers in panels to either side of the engine. Actuation of the spring-loaded rod repositions the associated bell crank and the catch bolts attached thereto.

When the instrument panel cover plate is opened and unlocked, the spring-loaded rod repositions so as to drive the associated catch bolts and bell crank linkage free from the corresponding set of catch plates. This unlocks the panels and plates and provides unrestricted access to the engine and its accessories. To lock the catch bolts and catch plates in position, it is only necessary to close the instrument panel cover. The instrument panel cover repositions the spring-loaded rod and the associated bell crank linkage. The instrument cover is then held in the locked position by a conventional padlock or combination lock.

This linkage thus provides an effective means of locking the various panels and covers associated with the engine and accessories in one simple stroke and with the use of a single lock. Other advantages of the invention will become apparent upon reading the following detailed description in reference to the drawings.

DETAILED DESCRIPTION

While this invention will be described in connection with a preferred embodiment, it will be understood that it is not intended to limit the invention to that specific embodiment. On the contrary, it is intended to cover all alternatives, modifications, and equivalents as may be included within the spirit and scope of the invention as defined by the appended claims.

Figure 1:
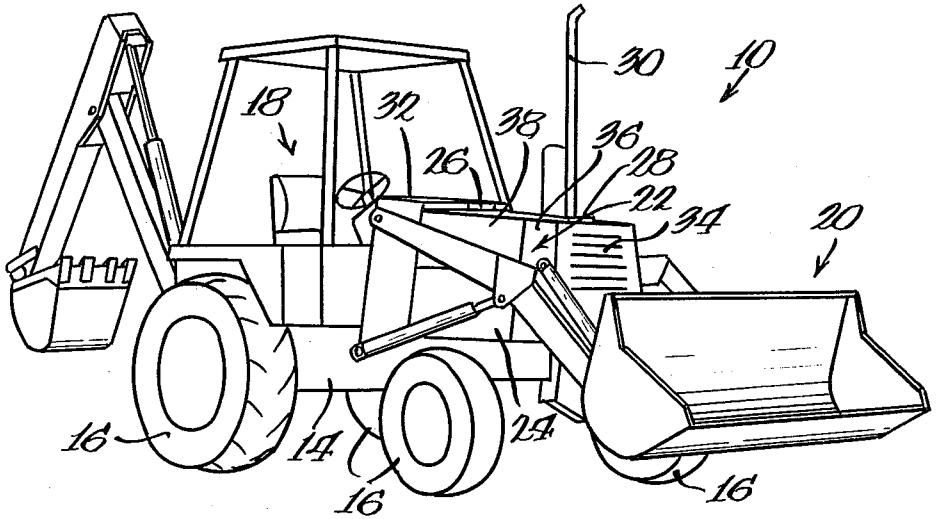
FIG. 1 is a perspective view of an off-road machine, specifically a backhoe, into which the present invention is installed.

FIG. 1 of the drawings shows an off-road machine, specifically a backhoe loader, having an earth-working tool or implement 12 supported thereon. The implement 12 consists of a backhoe which is immediately adjacent to an operator's station 18. The frame 14 of the machine 10 is supported by a set of four wheels 16. At the front end of the machine is a second earthworking tool 20 and the engine compartment 22. Access to the engine compartment is provided by a set of side covers 24 (only one being shown), a cover 26 providing access to the gas cap, and a cover 28 providing access to the radiator cap. In addition, an exhaust pipe 30 is shown protruding from the engine compartment 22. Within the operator's station 18, an instrument panel 32 is provided to monitor the operation of the engine and the various accessories. A grill 34 at the front end of the engine compartment 22 provides for the free flow of cooling air into the radiator. The radiator is surrounded by a cowling 36. At the top and near the center of this cowling 36 is located the cover 28 providing access to the radiator cap. The upper portion of the engine is covered by a generally semi-cylindrical top cover 38 affixed to the frame of the machine. To either side of this fixed top cover are located the two access covers or side panels 24 (only one being shown). These side panels 24 are removable to provide access to the engine for maintenance or repair. At the rear of the engine compartment, an instrument panel or dashboard 32 is provided. This panel provides a mounting frame for the various gauges and indicators used to operate the engine and its accessories. A pair of hinged cover plates 40, 41 (See FIG. 3) are used to protect these instruments from damage and vandalism. These two covers are locked in place by a padlock 42 passing through a pair of catch plates 43, 44.

Figure 2:
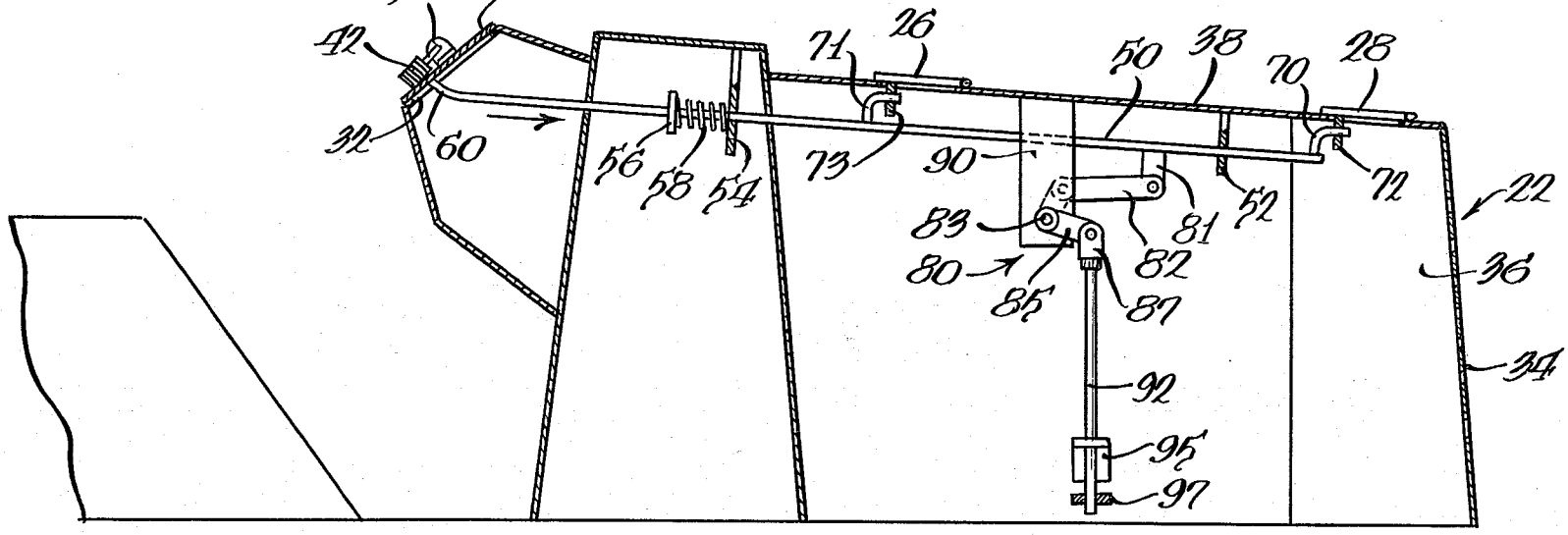
FIG. 2 is a partial, elevational view of the engine compartment of the vehicle shown in FIG. 1 illustrating the associated locking linkage.
Figure 3:
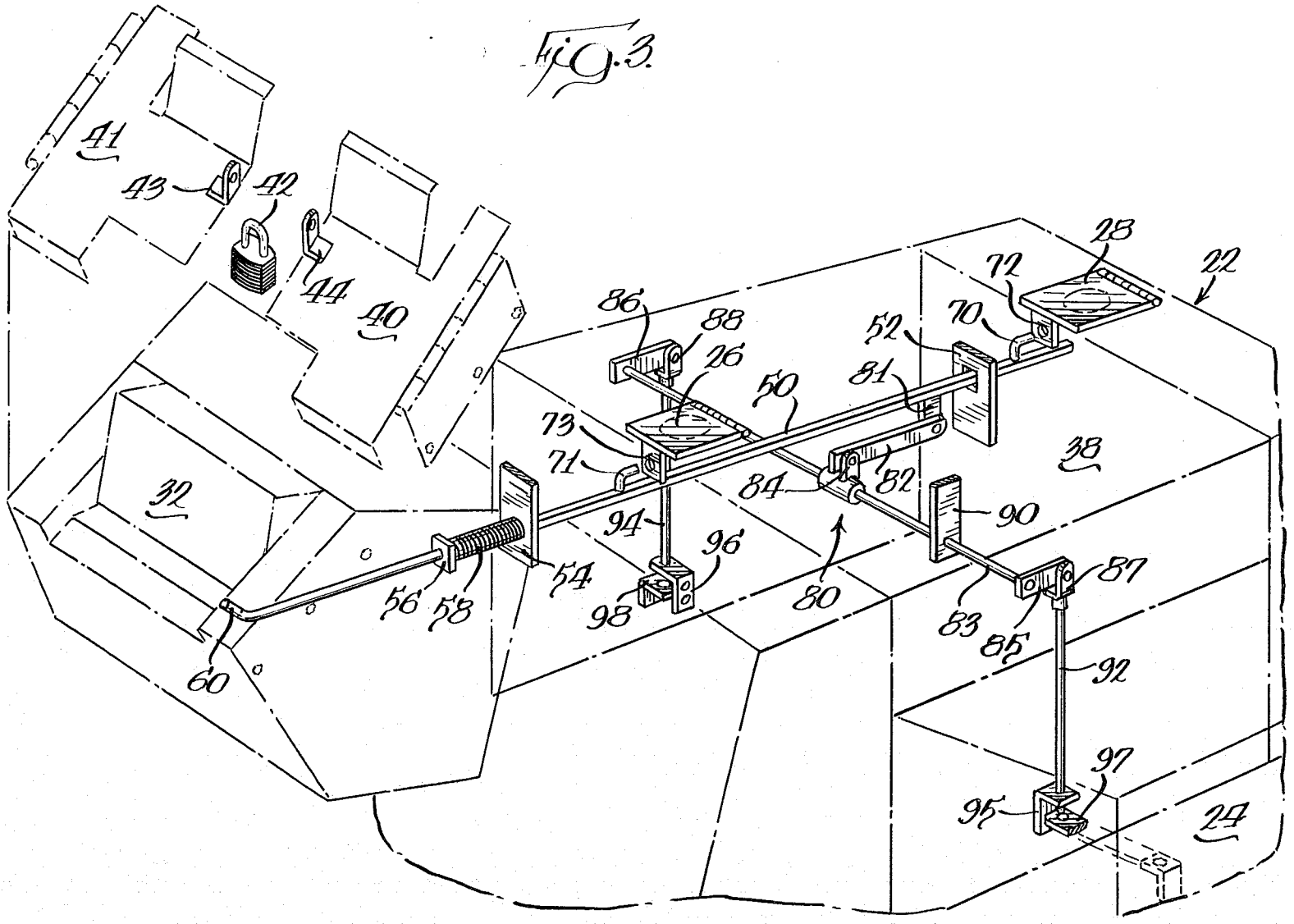
FIG. 3 is a perspective view of the linkage shown in FIG. 2 with the associated side panels and engine compartment housing shown in phantom.

The specific multiple lock system that is the subject of the present invention is illustrated in FIGS. 2 and 3. FIG. 2 shows an elevational side view of the linkage in the locked position. FIG. 3 is a perspective view of the linkage in an unlocked position. The operation of the invention will now be described. The reader is referred to FIGS. 2 and 3 to aid his understanding of the discussion to follow.

The main component of the lock is a spring-loaded shaft or bar 50. This bar 50 is positioned along the upper center line of the engine compartment 22. It is guided in the axial direction by a set of guides 52 and 54. These guides are fixed to a member, here the engine top cover 38, joined to the frame 14 of the machine. A fixed plate or stop 56 is positioned at one end of the bar 50. Between this plate 56 and one of the guides 54 a spring 58 is installed coaxially with the bar. The spring 58 thus biases the bar to a first position.

In order to move the bar 50 from a first position to a second position, it is necessary to overcome the force of the spring 58. One end 60 of the bar 50 protrudes into and out of the dashboard and beyond the face of the instrument panel 32 to which the locking covers 40, 41 are installed. Swinging the locking covers 40, 41 to the closed position has the effect of repositioning the spring-loaded bar 50 from its first to its second position.

Installed or attached at various positions along the rod are a series of catch bolts 70 and 71. Also, as shown in the drawings, two hinged cover plates 26 and 28 are installed atop the engine compartment 22. These plates are hingedly fixed to the top cover 38 of the machine. Specifically, one plate 28 provides access to the radiator cap while the other plate 26 provides an access to the gas cap. Attached to one end of each of these hinged cover plates is a catch plate 72 and 73. These catch plates 72, 73 cooperate with the corresponding catch bolts 70, 71 such that when the bar 50 is positioned from the first position to the second position, the catch bolts are engaged to catch plates, thus locking the two covers 26 and 28 in place.

While only two covers have been shown in the drawings, one or any number of covers may be installed using the principle just described to lock these covers in place. Similarly, while the covers have been shown hinged to the frame of the vehicle, the covers may, in fact, be completely removable. One or more catch plates may be installed on each cover. The same catch bolt or another catch bolt may be used to lock a cover in place when that cover has more than one catch plate. Finally, while the spring-loaded bar 50 has been shown positioned in the approximate center of the engine compartment 22, it may be mounted to either side of the engine compartment without affecting the operation of the invention.

For those panels and covers not located in the immediate proximity of the spring-loaded bar 50, a bell crank mechanism 80 is provided. Specifically, as shown in the drawings, the spring-loaded bar 50 has attached thereto a tab 81. This tab 81 is pivotally joined to a bell crank 80 by a connecting link 82. The connecting link 82 is pivotally joined to both the tab 81 and bell crank 80 by pivot pins. The bell crank 80 is supported by a set of guides 90 (only one being shown for clarity) attached to the frame of the machine or an equally difficult to remove or fixed member 38 of the machine. The bell crank 80 in turn manipulates a second set of catch bolts 92 and 94 located at either end. These catchbolts are guided in their movement by a set of guides 95, 96 also attached to a fixed member of the machine. Attached to the engine side panel covers 24 (only one being shown for clarity) are two catch plates 97, 98. These catch plates are aligned to match with the associated catch bolts 92 and 94 such that when the bell crank 80 is repositioned from a first position to a second position, the catch bolts engage the catch plates. The bell crank 80 is moved from the first position to the second position by moving the spring-loaded bar 50 from the first position to the second position. Since the bell crank 80 is pivotally connected to the spring-loaded rod, it is also biased to a first position.

As shown in the drawings, the bell crank 80 is comprised of the following parts: a rod or bar 83 positioned generally perpendicular to the spring-loaded bar 50; one arm of the bell crank attached to the center of the transverse rod 83 forming a first bell crank arm 84; and a set of second bell crank arms 85, 86 attached to the two ends of rod 83. The first and second set of bell crank arms 84, 85, 86 are rigidly connected to the transverse rod 83. The first bell crank arm 84 is pivotally joined to the connecting link 82. The two bell crank operated catch bolts 92, 94 are pivotally joined to the two second bell crank arms 85, 86.

As shown in the drawings a set of bifurcated hangers 87, 88 are positioned at the end of the two bell crank driven catch bolts 92, 94. Threadably joining the hangers 87, 88 to the catch bolts 92, 94 facilitates adjusting the stroke of the catch bolts 92, 94 relative to their catch plates 97, 98. Similarly the bifurcated first bell crank arm 84 can be locked to the shaft 83 by a set screw (not shown) thereby permitting the "throw" of each of the two bell crank driven catch bolts 92, 94 to be adjusted simultaneously. Other adjustment techniques will be apparent to one skilled in the art.

Thus, repositioning the spring-loaded bar 50 from the first position to the second position has the effect of rotating the bell crank 80 from its first position to its second position. Repositioning of the spring-loaded bar 50 and the bell crank 80, in turn, repositions the associated catch bolts 70, 71, 92, and 94 into their respective catch plates 72, 73, 97 and 98 such that with the spring-loaded bar 50 in the second position the two engine side panel covers 24 (only one being shown) the gas cap cover 26 and the radiator cap cover 28 are all locked in place. The spring-loaded bar 50 is repositioned from the first position to the second position simply by closing the instrument panel cover doors 40 and 41. These cover doors each have a catch plate 43 and 44 through which the hasp of a lock 42 is inserted. When the lock 42 holds the cover plates against the instrument panel 32, the associated spring-loaded bar 50 and bell crank 80 are forced to remain in the second or locked position. Other locking mechanisms, besides padlocks, may be used.

To open these locks, it is only necessary for the machine operator to remove a single padlock 42 and open the two instrument panel doors 40 and 41. This results in the spring 58 repositioning the longitudinal bar 50 from the second to the first position and the associated bell crank 80 rotating from its second to its first position. The effect of moving the bar 50 and the bell crank 80 to the second position is that the various catch bolts are removed from their associated catch plates.

Thus, it is apparent that there has been provided in accordance with the invention just described a linkage mechanism forming a multiple lock system that effectively satisfies the problems associated with the present state of the art. While the invention has been described in conjunction with a specific embodiment, it is evident that many alternatives, modifications and variations will be apparent to those skilled in the art in light of the foregoing description. Accordingly, it is intended to enhance all such alternatives, modifications and variations as set forth within the spirit and broad scope of the appended claims.

I claim:

1. A locking linkage for the engine compartment of an off-road machine used for material handling, excavation, and the like, said machine having at least two openings providing access to the engine and engine accessories and at least two covers for those openings, comprising:

(a) a first shaft, said shaft being located within said compartment and guided axially in movement between a first position and a second position, the axis of said shaft being fixed relative to said covered openings and said machine;

(b) means, abutting a fixed member on said machine, for biasing said first shaft in a first position;

(c) lock means, attached to a fixed member on said machine, for holding said first shaft in said second position;

(d) at least one bell crank rotatable relative to a fixed member of said machine between a first position and a second position about a fixed axis perpendicular to the axis of said first shaft, one end of said bell crank being linked to said first shaft, shifting said first shaft from said first position to said second position rotates said bell crank about said fixed axis from said first position to said second position of said bell crank;

(e) a plurality of catch plates and cooperating catch bolts, said catch plates being joined to said covers on said machine, at least one of said catch bolts being joined to and moved by said first shaft, at least one of said catch bolts being joined to and moved by the other end of said bell crank, said catch plates and catch bolts being disengaged when said first shaft is in said first position, said catch plates and catch bolts being engaged when said first shaft is in said second position, the effect of holding said first shaft and said bell crank in said second position by said lock means being that said covers on said machine are locked in position relative to the fixed members of said machine whereby locking said first shaft in said second position locks said access covers to said machine.

2. The linkage defined in claim 1, wherein said at least one of said plurality of catch bolts joined to said first shaft is rigidly attached to said first shaft.

3. The linkage defined in claim 1, wherein said at least one of said plurality of catch bolts joined to the other end of said bell crank is pivotally joined to said other end of said bell crank and is guided in direction to be drawn between a first position and a second position along an axis generally perpendicular to a plane passing through the axis of said first shaft.

4. The linkage defined in claim 1, wherein said lock means comprises:

(a) at least two cover plates hingedly connected to a fixed member on said machine and swingable from an opened to a closed position, each of said cover plates having a catch plate, said catch plates being arranged such that with such cover plates in the closed position said catch plates are coaxially aligned; and (b) means for padlocking together at least two catch plates, said padlocking means joining together said catch plates on said at least two cover plates, closing said at least two cover plates having the effect of aligning said catch plates together and shifting said first shaft from said first position to said second position, inserting and locking said padlocking means through said catch plates having the effect of locking together said plurality of catch plates and catch bolts thereby preventing access to said engine and engine accessories.

5. The linkage defined in claim 1, wherein said bell crank comprises: a first arm; a second arm, the planes of said first arm and said second arm being generally parallel to each other; and a connecting shaft generally perpendicular to a plane passing through said first shaft, said first arm and said second arm each having one end attached to said connecting shaft, the other end of said first arm and the other end of said second arm defining the two ends of said bell crank, said second shaft defining the axis of rotation of said bell crank, said at least one of said plurality of catch bolts positioned by said bell crank being pivotally joined to one end of said bell crank with said first shaft being pivotally linked to the other end of said bell crank whereby said at least one of said plurality of catch bolts positioned by said bell crank lies in a plane spaced from and parallel the plane of said first shaft.

6. The linkage defined in claim 1, wherein two catch bolts are driven by said first shaft, each one of said two catch bolts having at least one cooperating catch plate joined to one of two access covers, at least one of said two access covers being hingedly joined to a fixed member on said machine, said two access covers covering a gas cap connection for said engine and a radiator cap for said engine.

7. The linkage defined in claim 1, wherein said at least one of said plurality of catch bolts driven by said bell crank is directed in motion by a at least one guide attached to a fixed member of said machine, said guide maintaining the longitudinal axis of said at least one of said plurality of catch bolts driven by said bell crank in a generally vertical direction.

8. The linkage defined in claim 1, wherein said at least one of said plurality of catch plates engaging said at least one of said plurality of catch bolts driven by said bell crank is joined to an engine side panel cover, said engine side panel cover when removed providing access to the engine compartment of said machine.

9. The linkage defined in claim 1, wherein said biasing means is a coil spring, said coil spring being coaxial with said first shaft, said spring being compressed between a first stop and a second stop, said first stop being attached to a fixed member of said machine, said second stop being attached to said first shaft.

10. The linkage defined in claim 1, wherein said lock means comprises:

(a) at least one hinged plate, said plate being hinged to a fixed member on said machine, said plate swinging between an open and a closed position, said plate covering the instrument panel of said machine; and (b) means, joining said hinged plate to said machine, for locking said hinged plate in the closed position, the effect of locking said hinged plate in the closed position being that said first shaft is repositioned from said first position to said second position, said second position being that position where said plurality of catch plates and catch bolts are engaged thereby locking said at least two covers providing access to said engine and engine accessories.

11. The linkage defined in claim 10, wherein said means for locking said hinged plate comprises:

(a) a first catch plate joined to said hinged plate;

(b) a second catch plate attached to a fixed member of said machine and aligned to said first catch plate with said hinged cover in the closed position; and (c) means for padlocking together said first catch plate and said second catch plate to hold said hinged plate in the closed position.

12. In an off-road machine used for excavating, material handling operations and the like, wherein said machine includes: a removable panel for gaining access to the engine driving said machine; a hinged cover capping an opening providing access to an engine component; a cover plate protecting the instrument panel of said machine, said instrument panel cover plate having a first catch plate; a plurality of catch plates joined to said removable panel and to said hinged cover; and a second catch plate attached to said machine, passing the shackle of a lock between said first catch plate on said instrument panel cover plate and said second catch plate having the effect of locking said cover plate in position relative to said machine, wherein the improvement comprises:

(a) a shaft within the interior of said machine, said shaft being guided in movement between a first position and a second position, the axis of said shaft being fixed relative to said machine;

(b) means, abutting a fixed member of said machine, for biasing said shaft in a first position, said shaft in said first position extending outwardly from the interior of said machine in the direction of said instrument panel cover plate, said shaft being repositioned to said second position upon joining said first catch plate to said second catch plate with said lock, locking said instrument panel cover plate thus having the effect of locking said shaft in said second position;

(c) at least one bell crank, said bell crank being joined to a fixed member of said machine and rotatable between a first position and a second position about a fixed axis passing through said bell crank, one end of said bell crank being pivotally linked to said shaft, moving said shaft from said first position to said second position having the effect of rotating said bell crank from said first position to said second position of said bell crank; and (d) at least two catch bolts cooperating with said plurality of catch plates, one of said catch bolts being joined to the other end of said bell crank, the other of said two catch bolts being joined to said shaft, whereby upon shifting said shaft from said first position to said second position by locking said instrument panel cover plate to said machine, said at least two catch bolts engage said plurality of catch plates to lock said hinged cover and said removable panel in position relative to said machine.

* * * * *